US006358015B1

(12) United States Patent
Kakovitch

(10) Patent No.: US 6,358,015 B1
(45) **Date of Patent: *Mar. 19, 2002**

(54) METHOD AND APPARATUS FOR IMPROVING FLUID FLOW AND AERATING LIQUIDS

(76) Inventor: Thomas Kakovitch, 2720 Fox Mill Rd., Herndon, VA (US) 20170-2011

( * ) Notice: Subject to any disclaimer, the term of this patent is extended or adjusted under 35 U.S.C. 154(b) by 0 days.

This patent is subject to a terminal disclaimer.

(21) Appl. No.: 09/551,697

(22) Filed: Apr. 18, 2000

Related U.S. Application Data

(63) Continuation-in-part of application No. 09/007,108, filed on Jan. 14, 1998, now Pat. No. 6,071,083.

(51) Int. Cl.[7] ..... F04B 23/08

(52) U.S. Cl. ..... 417/84; 417/87; 417/171; 417/194

(58) Field of Search ..... 417/84, 87, 151, 417/171, 174, 194, 198; 60/262, 265, 266; 239/127.3, 265.17

(56) References Cited

U.S. PATENT DOCUMENTS 2,612,750 A * 10/1952 Goddard ..... 60/266
3,981,143 A * 9/1976 Ross et al. ..... 239/127.3
5,269,132 A * 12/1993 Loucks ..... 60/265

FOREIGN PATENT DOCUMENTS

FR 947141 A * 6/1949 ..... 417/194
GB 2189843 A * 4/1987 ..... 417/151

* cited by examiner

*Primary Examiner*—Cheryl J. Tyler
(74) *Attorney, Agent, or Firm*—Dennison, Scheiner & Schultz

(57) ABSTRACT

A fluid flow promoter for increasing and accelerating the flow of fluids through channels, and useful in marine propulsion and aeration of liquids includes 1) an outer shell including an inlet end wall, an outlet end wall, and a solid truncated wall, 2) a fluid inlet generally centrally located in the inlet end wall, 3) an inner truncated cone with an inlet corresponding to the outer shell inlet and an outlet corresponding to the outer shell outlet, disposed within the outer shell and comprising end and side walls defining a space between the outer shell and the inner cone, the end and side walls of the inner truncated cone being perforated to permit fluid flow therethrough, and 4) a plurality of secondary fluid inlets disposed in the end or side wall of the outer shell. The apparatus is also useful in increasing the thrust of rockets and other jet exhaust devices, and for moving light gases such as helium in modular helium reactors.

14 Claims, 5 Drawing Sheets

METHOD AND APPARATUS FOR IMPROVING FLUID FLOW AND AERATING LIQUIDS

This application is a continuation-in-part of U.S. application Ser. No. 09/007,108 filed Jan. 14, 1998 now U.S. Pat. No. 6,071,083.

BACKGROUND OF THE INVENTION

The invention relates to the field of improving and increasing the flow of fluids, especially water, and especially as applied to propelling water craft.

Various facilities require moving large quantities of fluids as efficiently as possible. Such facilities include waste water treatment plants, cooling towers, and large aquariums in which aeration takes place. In addition, the efficient movement of large quantities of water is necessary for the propulsion of all types of water craft, including large and small ships, pleasure craft and jet skis.

Marine propulsion is generally accomplished either by means of a propeller driven by an engine, or by means of a jet of water produced by a pump and expelled through a nozzle. Conventional propellers are especially troublesome, as they cause cavitation at high speeds and cannot drive a ship at speeds above about 30 knots. In cavitation, the pressure on forward surfaces becomes so low that the water "boils" and creates damaging vibrations.

In U.S. application Ser. No. 09/007,108 filed Jan. 14, 1998, and incorporated herein by reference, Applicant proposed a gas flow director for more efficiently moving gas in order to reduce pressure in a chamber.

In order to reduce the pressure in a chamber, it is well known to use a fan, compressor or other type of gas movement device to blow the gas in the chamber outwardly. The efficiency of such a device lasts only so long as there is gas in the chamber to be evacuated, since the gas assists in turning the fan blades, and reduces the amount of electrical power which must be used to operate the fan. When the pressure in the chamber has been reduced, there is less gas being moved to turn the fan blades, so more electrical power must be applied to the fan to move the blades. The reduction in efficiency at reduced pressures is considerable, and requires the use of a fan sized to be effective at reduced pressure.

The gas flow director proposed in U.S. application Ser. No. 09/007,108 included a pair of corresponding truncated cones, an inner cone and an outer cone defining a space therebetween, with a gas inlet at the larger end of the apparatus and a gas outlet at the smaller end of the apparatus defining a gas flow path through the apparatus. The outer cone has a series of secondary gas inlets at the larger end, and the inner cone is perforated over its surface. The secondary flow of gas through the secondary inlets and the perforations, was found to greatly improve the efficiency of the primary flow of gas.

However, it is also desirable to improve the flow of fluids, in general, and liquids in particular, for numerous application, including propulsion and aeration.

SUMMARY OF THE INVENTION

It is therefore an object of the invention to utilize the apparatus as disclosed in U.S. application Ser. No. 09/007,108 for moving fluids, and in particular liquids and liquid-gas mixtures.

It is a further object of the invention to utilize this apparatus in a liquid flow circuit for purposes of marine propulsion.

It is another object of the invention to utilize this apparatus for aeration of liquids.

It is another object of the invention to increase the thrust of a rocket or jet propulsive device by inducing an additional mass of gases into the exhaust stream of the device.

It is another object of the invention to increase the thrust of a rocket or jet propulsive device by reducing the pressure of gases at the exhaust outlet of the device.

These and other objects of the invention are achieved with an apparatus for improving fluid flow, and which comprises an outer shell having an inlet end which is generally closed with a centrally located inlet, a solid truncated side wall, and an outlet end with an outlet therein. Within the outer shell is an inner truncated cone having a larger inlet end generally parallel to the inlet end of the outer shell and side walls, define a space between the side walls of the inner cone and the outer shell. An inlet in the smaller end of the inner cone corresponds to the inlet in the outer cone. The inlet and the outlet define a fluid flow passage through the inner cone. The end and side walls of the inner truncated cone are perforated to permit flow therethrough, the perforations providing a passage between the shells and the fluid flow passage. The inner cone has an outlet corresponding to the outlet of the outer shell.

A plurality of secondary inlets open to the environment are placed in the side wall or the end wall of the outer shell, or in both the side wall and the end wall. These inlets may themselves be in the form of truncated cones, with the smaller ends of these cones passing into the side wall of the outer shell.

The inner truncated cone may have any conical shape between 1 and 89°, but is preferably about 15 to 75°.

The outer shell is frequently in the form of a truncated cone corresponding to the inner truncated cone. The outer shell can also have other cross-sections, for example, cylindrical or rectangular.

In operation, a device for moving a fluid, for example a propeller, a pump or a compressor, is used to supply a fluid which will be referred to as a working fluid to the inlet; the working fluid may be a liquid or a gas or a combination thereof. The secondary inlet is supplied with an ambient or compressed gas or a liquid, or combination thereof, which is then induced into the higher pressure flow of the working fluid. In the case of an induced gas, compression of the gas into the working fluid results, creating a homogenized compressed stream liquid/gas at the outlet. The subsequent expulsion of the compressed gas/liquid and the mass flow augmentation due to induction will enhance the thrust of a propulsive system.

While not wishing to be held to a particular explanation, Applicant theorizes that the apparatus incorporates the aerodynamics and fluid dynamics of three-dimensional circulation around a closed path in an irrotational field described by the Law of Biot and Savart. In comparison, an airfoil is a flat or two dimensional application of the Law of Biot and Savart. The operation of the apparatus is thought to be based on the fact that every irrotational flow possesses a velocity potential. The Kutta-Joukowski theorem relates the velocity potential to a force. The apparatus is designed to turn the velocity potential generated force into an impulsive force applied throughout a three-dimensional finite region, the curl of the force having a value at its edge and creating vorticity. This vorticity creates molecular acceleration and turbulence, which thereby creates suction.

The apparatus of the invention has no moving parts, and can withstand high pressures generated by the working fluid.

It is not restricted in the volume of gases and liquids which can be induced, but subject only to the volume flow and pressure of the working fluid. In contrast to a venturi, the apparatus of the invention does not depend on narrowing of an area to create an increase in fluid velocity, and thereby a drop in pressure.

DESCRIPTION OF THE PREFERRED EMBODIMENTS

Figure 1:
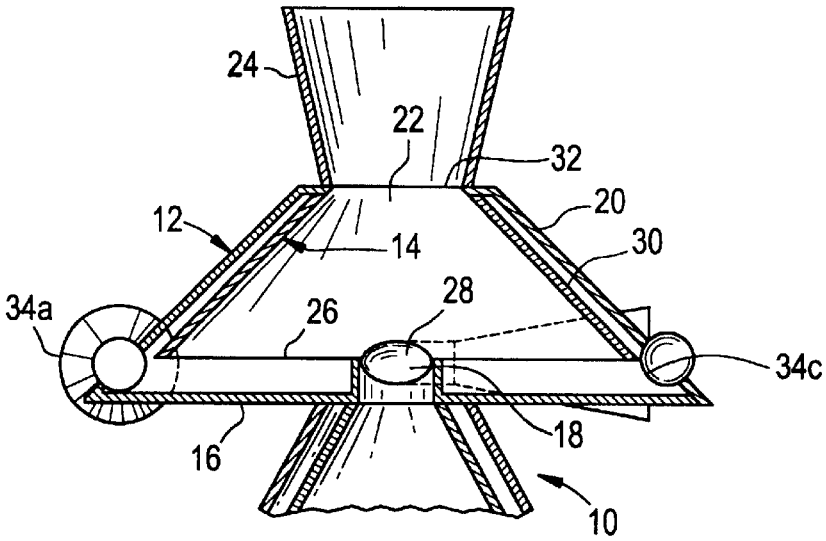
FIG. 1 is a longitudinal cross-sectional view of the apparatus according to the invention.

Shown in FIG. 1 is a fluid flow promoting device 10 according to the invention including an outer shell in the form of a truncated cone 12 and an inner truncated cone 14. Outer truncated cone 12 includes an end wall 16 with a central inlet 18 at its larger end, a side wall 20 and an outlet 22 at its open smaller end. A connector 24 is provided at the outlet.

Inner truncated cone 14 includes a perforated end wall 26 with an inlet 28 aligned with inlet 18, a perforated side wall 30 and an open outlet 32 aligned with outlet 22.

The outer cone has an inner diameter of 49" at the large end and a height of 18". The smaller cone has an inner diameter of 45" and a height of 15", leaving a space of 3" between the end wall and 2" between the side walls. Both cones taper to a smaller end of 9" diameter. The gas inlet for both cones is 5.4" in diameter located in the center of each cone.

Figure 2:
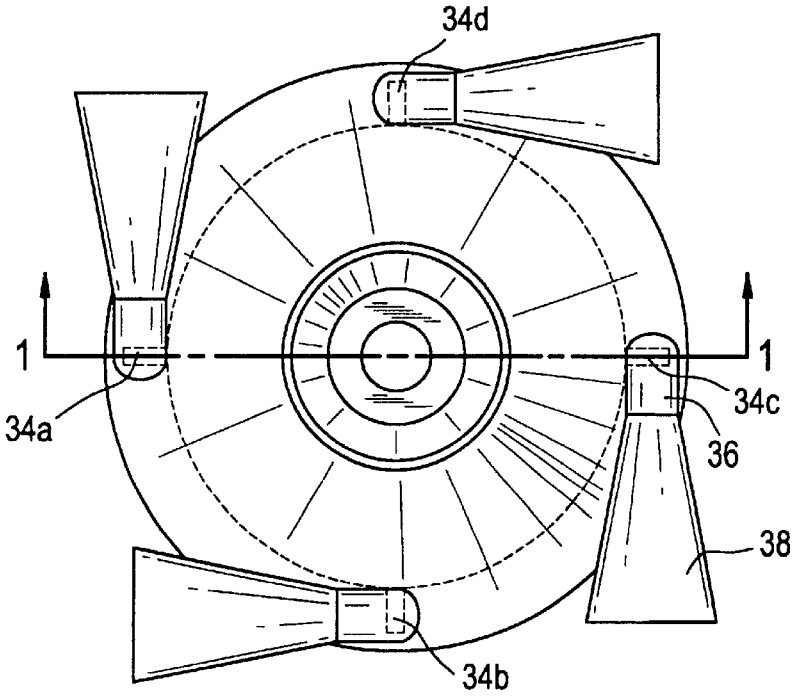
FIG. 2 is a top plan view of the apparatus shown in FIG. 1.

The secondary inlets are disposed in the space between the outer and inner cones, at the junction of the side and end wall, and are best viewed in FIG. 2. Four secondary inlets 34*a*–34*d* are disposed at 90° with respect to each other, with each inlet comprising a connector 36 passing through the outer cone and an air guide 38 of truncated conical shape at the end of each connector 36.

Figure 1A:
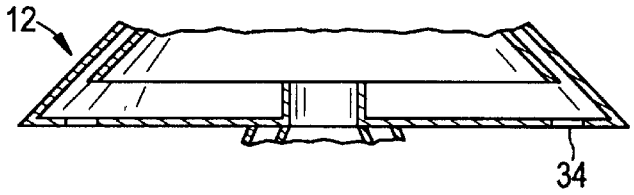
FIG. 1*a* is a partial schematic cross-sectional view of a variation of the gas flow director shown in FIG. 1.

In a variation of the embodiment of FIG. 1 which is shown in FIG. 1*a*, secondary gas inlets 34 are provided in the end wall of the outer cone, rather than the side wall.

Figure 3:
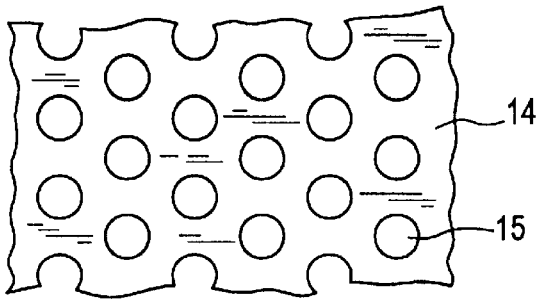
FIG. 3 is a plan view of a perforated material used for the inner cone of FIG. 1.

FIG. 3 shows a perforated metal sheet 14 used for the inner cone. The sheet is designated 3/16" staggered, with each hole 15 having a diameter of 0.1875", 12 holes per square inch. 33% of the sheet is open for passage of fluid.

The particular perforated sheet shown is typical of commercially available materials useful for the invention, but is not critical. Other configurations, hole sizes and open areas may be used, depending on the fluid flow necessary.

Figure 4:
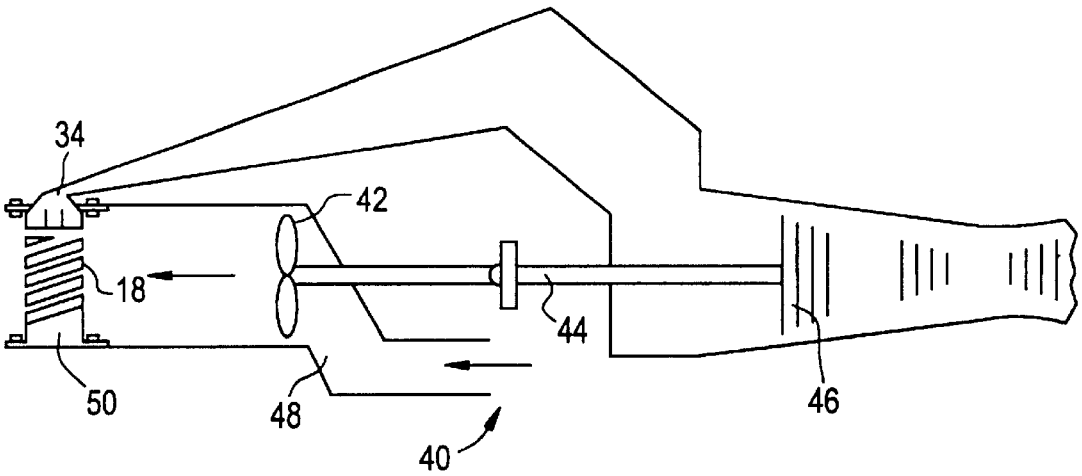
FIG. 4 is a schematic, cross-sectional view of a marine propulsion system incorporating the apparatus of the invention.

FIG. 4 shows a marine propulsion system 40 incorporating an apparatus according to the invention, including a propeller 42 mounted on a drive shaft 44, driven by a motor 46. The propeller is mounted in a channel 48 in which water is moved in the direction of the arrow. A fluid flow promoter 50 is mounted downstream of the propeller with a central inlet 18 receiving water from the propeller and secondary inlets 34 receiving air.

Figure 5:
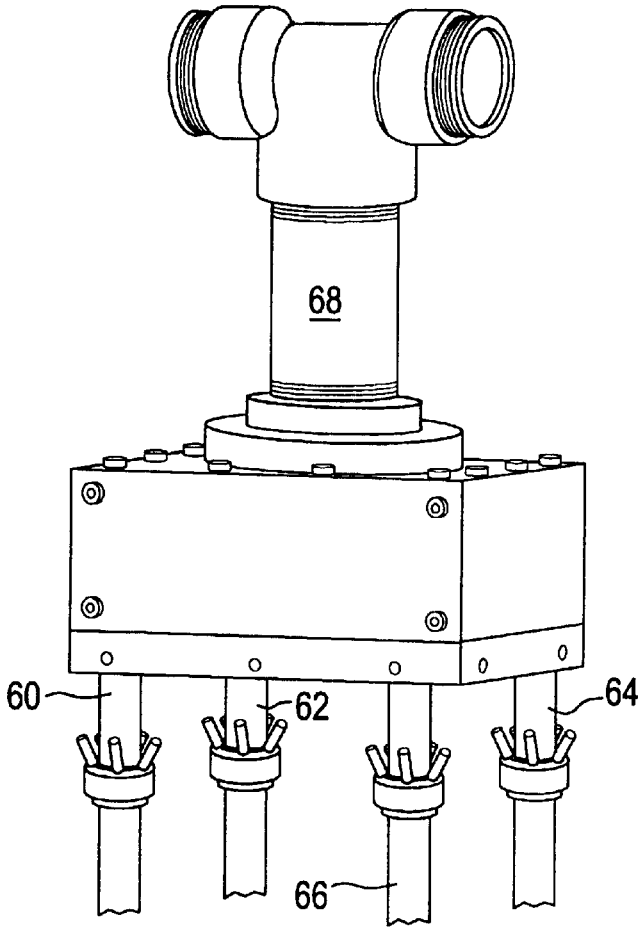
FIG. 5 is a perspective view of a system incorporating four apparatus according to the invention arranged in parallel.
Figure 6:
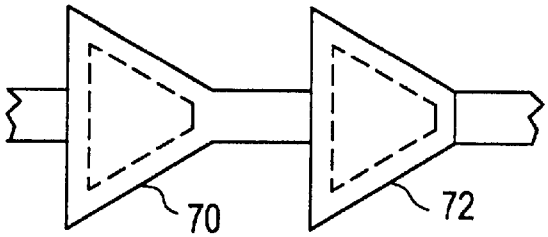
FIG. 6 is a schematic diagram of a system incorporating apparatus according to the invention placed in series.

For greater increase in fluid flow, it is possible to mount multiple devices in parallel, as shown in FIG. 5. Thus, FIG. 5 includes devices 60, 62, 64 and 66 mounted in parallel, connected to a common inlet 68. Devices 70 and 72 can also be placed in series, as shown in FIG. 6.

Figure 7:
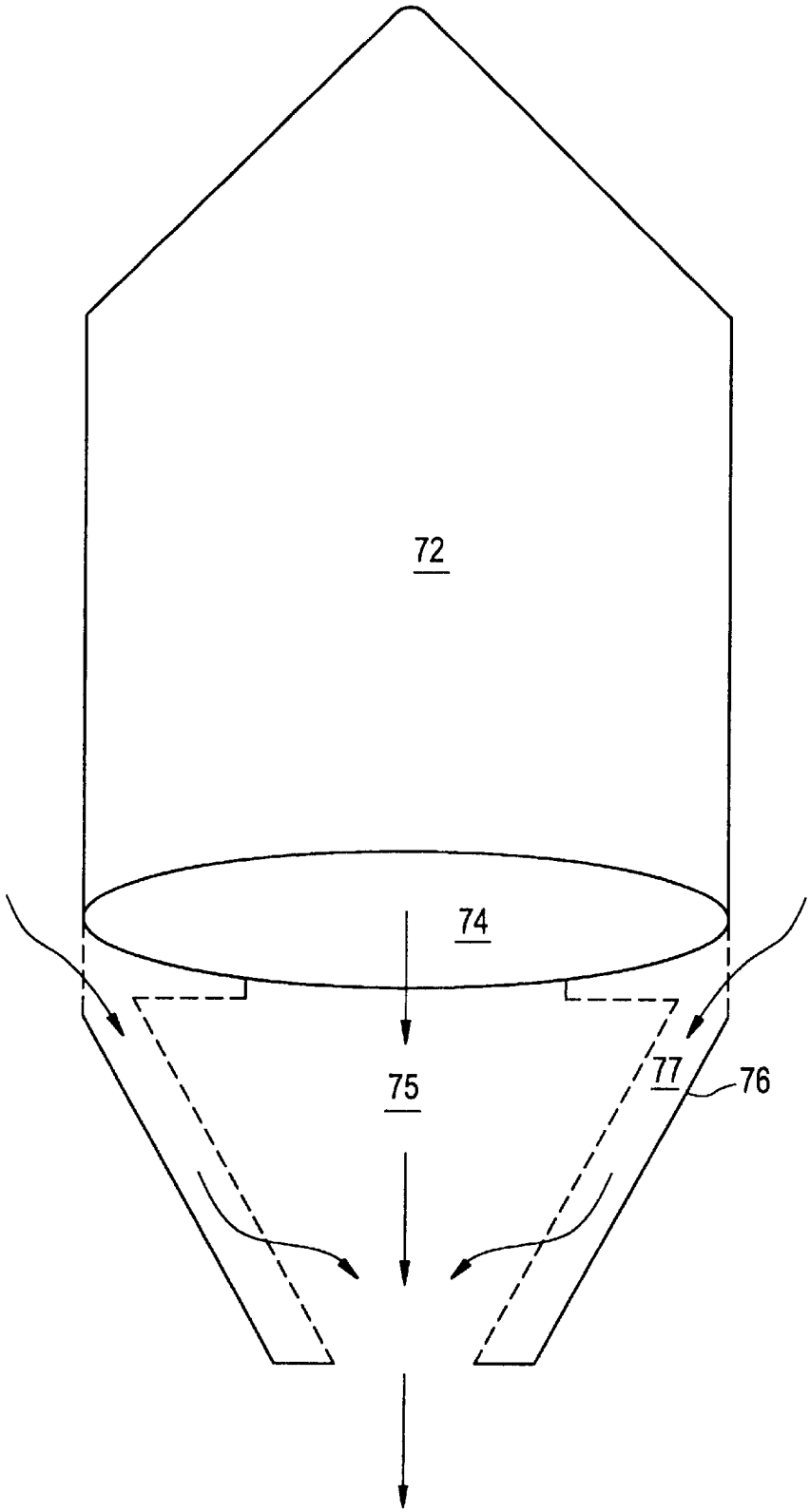
FIG. 7 is a schematic diagram of the apparatus of the invention used in conjunction with a rocket or turbine.

The invention can also be used to increase the efficiency of rockets and jet engines by reducing the pressure of the exhaust at the outlet of the rocket or turbine. The thrust is thus increased by increasing the mass of gases into the exhaust stream. Such an arrangement is shown in FIG. 7, in which the exhaust 74 or rocket 72 is connected to the primary inlet 75 of promoter 76, with secondary inlets 77 receiving ambient air.

Figure 8:
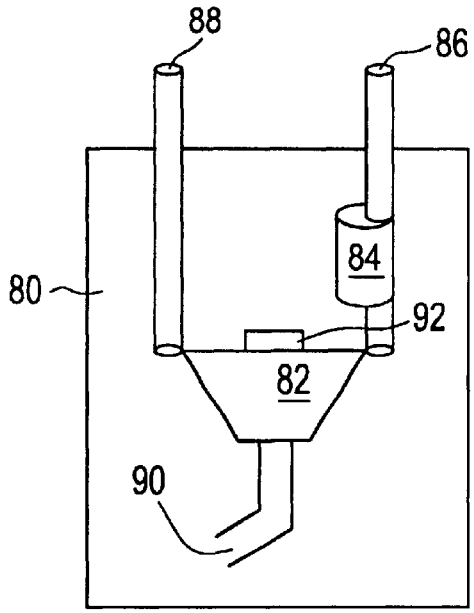
FIG. 8 is a schematic diagram of a submersible aerator utilizing the apparatus of the invention.

In a particularly advantageous embodiment, the apparatus of the invention is used to aerate liquids. FIG. 8 shows a depth-independent submersible aerator 80 including an apparatus 82 according to the invention, connected to a pump 84 with a water inlet 86. Compressed air is supplied to apparatus 82 through air line 88, and aerated water is expelled through outlet 90. The apparatus may also include a remote data sensing device 92, which transmits data to a remote location.

Figure 9:
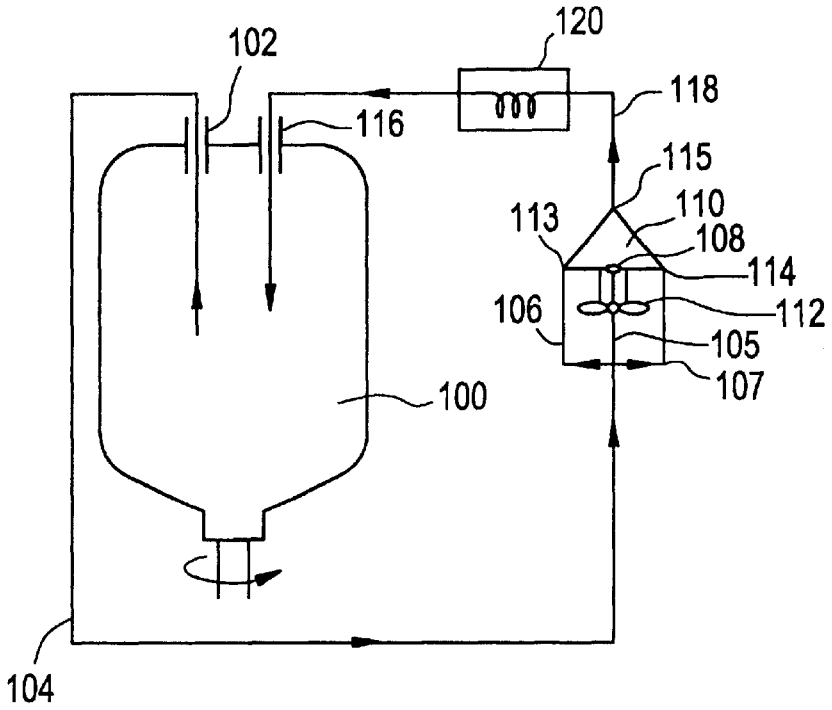
FIG. 9 is a schematic diagram of a modular helium reactor utilizing the apparatus of the invention.

Because the apparatus of the invention is effective in moving light gases, it can advantageously be used in connection with a modular helium nuclear reactor 100, as shown in FIG. 9, in which helium gas is the working fluid. Heated

What is claimed is:

1. A fluid flow promoter comprising:

an outer shell comprising a generally closed inlet end wall having a primary inlet therein, an outlet end comprising an outlet therein, and a generally solid side wall;

an inner truncated cone disposed within the outer shell, and comprising larger end wall generally parallel to the inlet wall of the outer shell and side walls, defining a space between the outer end and side walls of the outer shell and the larger end and side walls of the inner truncated cone;

the inner truncated cone comprising an inlet in the larger end thereof aligned with the primary inlet in the outer shell, and a smaller end comprising an outlet aligned with the outlet of the outer shell, defining a fluid flow passage between the inlet and the outlet of the inner truncated cone, the inner truncated cone further comprising a plurality of perforations therethrough extending between the space and the fluid flow passage, and a plurality of secondary inlets disposed in the side wall of the outer shell, or in the end wall of the outer shell.

2. Fluid flow promoter according to claim 1, wherein the secondary inlets are disposed in the side wall of the outer shell.

3. Fluid flow promoter according to claim 2, wherein the secondary inlets have a truncated conical shape with a smaller end connected to the side wall of the outer shell, the secondary inlets being disposed to provide fluid flow therethrough in a direction generally tangential to the side wall of the outer shell.

4. Fluid flow promoter according to claim 1, wherein the secondary gas inlets are disposed in the end wall of the outer shell.

5. Fluid flow promoter according to claim 1, wherein the outer shell is a truncated cone with a larger end wall and a smaller end, the inlet wall being the larger end and the outlet wall being the smaller end, the larger end being generally parallel to the larger end of the inner truncated cone.

6. A propeller driven marine propulsion system comprising a fluid flow promoter according to claim 1, in combination with a propeller disposed adjacent the inlet of the outer shell.

7. A jet driven marine propulsion system comprising a fluid flow promoter according to claim 1, in combination with pump means for providing a flow of water to the inlet of the outer shell.

8. A propulsion apparatus comprising a rocket or turbine having an exhaust for delivering thrust for propulsion, and including at the exhaust at least one fluid flow promoter according to claim 1.

9. A liquid aerator comprising a fluid flow promoter according to claim 1, in combination with a source of air connected to the secondary inlets, and a liquid pump connected to the primary inlet.

10. A method for promoting flow of fluid through a channel, comprising disposing in the channel a fluid flow promoter comprising an outer shell comprising a generally closed inlet end wall having a primary inlet therein, an outlet end comprising an outlet therein, and a generally solid side wall;

an inner truncated cone disposed within the outer shell, and comprising larger end wall generally parallel to the inlet wall of the outer shell and side walls, defining a space between the outer end and side walls of the outer shell and the larger end and side walls of the inner truncated cone;

the inner truncated cone comprising a fluid inlet in the larger end thereof aligned with the primary inlet in the larger end of the outer truncated cone, and a smaller end comprising a fluid outlet aligned with the fluid outlet of the outer truncated cone, defining a fluid flow passage between the fluid inlet and the fluid outlet of the inner truncated cone;

the inner truncated cone further comprising a plurality of perforations therethrough extending between the space and the fluid flow passage; and a plurality of secondary inlets disposed in the side wall of the outer shell, or in the end wall;

forcing a flow of working fluid through the fluid flow promoter, from the inlet to the outlet; and passing a secondary fluid through the secondary inlets.

11. A method according to claim 10, wherein ambient atmosphere is induced to flow into the secondary inlet.

12. A method according to claim 10, wherein the working fluid is a gas, liquid or a mixture of liquid and gas.

13. A method according to claim 10, wherein the secondary fluid is a gas, liquid or a mixture of liquid and gas.

14. A method according to claim 10, wherein the secondary fluid is compressed gas. helium exits the reactor at outlet 102 through a line 104, which divides into lines 105, 106 and 107. Line 105 connects to the main inlet 108 of apparatus 110; a fan 112 is used to move the helium. Lines 106 and 107 connect to secondary inlets 113 and 114, respectively. The outlet 115 of the apparatus is connected to reactor inlet 116 through a line 118 and cooler 120.

* * * * *